US006036519A

United States Patent [19]

Lopata et al.

[11] Patent Number: 6,036,519

[45] **Date of Patent: *Mar. 14, 2000**

[54] CIRCUIT CARD CONNECTOR UTILIZING FLEXIBLE FILM CIRCUITRY

[75] Inventors: John E. Lopata, Redwood City; Russell G. Larsen, San Jose, both of Calif.

[73] Assignee: Molex Incorporated, Lisle, Ill.

[ * ] Notice: This patent is subject to a terminal disclaimer.

[21] Appl. No.: 08/934,836

[22] Filed: Sep. 22, 1997

Related U.S. Application Data

[63] Continuation of application No. 08/635,049, Apr. 17, 1996, Pat. No. 5,679,018.

[51] Int. Cl.[7] ..... H01R 13/15

[52] U.S. Cl. ..... 439/260; 439/62

[58] Field of Search ..... 439/260, 62, 59, 439/67, 77, 629, 630, 632, 259, 261, 262, 263, 264, 265, 266, 267, 493

[56] References Cited

U.S. PATENT DOCUMENTS

| | | | |
|---|---|---|---|
| 3,614,707 | 10/1971 | Kaufmann et al. | 339/17 |
| 4,894,022 | 1/1990 | Guckenheimer | 439/260 |
| 5,308,249 | 5/1994 | Renn et al. | 439/62 |
| 5,308,257 | 5/1994 | Buchter et al. | 439/267 |
| 5,316,486 | 5/1994 | Tanaka et al. | 439/62 |
| 5,427,533 | 6/1995 | Chambers | 439/62 |
| 5,507,651 | 4/1996 | Tanaka et al. | 439/67 |
| 5,564,931 | 10/1996 | Fabian et al. | 439/62 |

*Primary Examiner*—Paula Bradley
*Assistant Examiner*—Ross N. Gushi
*Attorney, Agent, or Firm*—Charles S. Cohen

[57] ABSTRACT

A circuit card connector utilizes flexible circuitry and a card-engagement assembly which applies a normal force to the contact pads of the circuit card. The connector includes two opposing connector end portions and a card-engagement assembly extending therebetween, the card-engagement assembly including two opposing spring members which are seated upon a pair of fulcrums. The spring members are spaced apart from each other on opposite sides of a centerline of a card-receiving slot of the connector. The spring members have lower leg portions and upper contact arm portions. The leg portions of the spring members project into the card-receiving slot such that an insertion edge of the circuit card will impinge thereupon and cause them to spread apart, which in turn, will cause the contact arm portions of the spring members to rotate around their associated fulcrums so that the contact arm portions will contact and exert a normal force upon contact pads located on opposing sides of the circuit card near the circuit card insertion edge.

17 Claims, 9 Drawing Sheets

30
34
40
41
43
44
46
47
50
52
53
54
55
56
57
58
59
60
62
64
65
66
67
70
71
72
73
74
76
78
80
22
36
C
D
F
N
R

CIRCUIT CARD CONNECTOR UTILIZING FLEXIBLE FILM CIRCUITRY

REFERENCE TO RELATED APPLICATIONS

This is a continuation application of prior application Ser. No. 08/635,049, filed Apr. 17, 1996, now U.S. Pat. No. 5,679,018.

BACKGROUND OF THE INVENTION

The present invention relates generally to edge card connectors, and more particularly to circuit card connectors which utilize flexible circuitry as the contacts of the connector and which have an improved card engagement means.

Connectors are well known in the art which provide a connection between a primary circuit board, or "motherboard" and a secondary circuit board or "daughterboard." The connections between these two printed circuit boards typically occur along an edge the secondary circuit board, and hence such secondary circuit boards are commonly referred to in the art as edge cards.

Such circuit connectors typically include an insulative housing having a printed circuit card-receiving slot extending lengthwise within the connector, and a plurality of flexible conductive contacts which are located on opposing sides of the card-receiving slot. These contacts are typically stamped and formed. In an effort to further reduce the size of electronic components, connectors have been reduced in size and the "pitch" of connectors, i.e., the spacing between the connector contacts, has become smaller. The stamping and forming manufacturing process imposes limitations on the pitch which occurs between the contacts and therefore limits the number of circuits which the connector may accommodate. Currently, minimum pitches of about 0.5 mm are obtainable using stamped and formed contacts. This minimum pitch limits the amount of circuits for such a connector.

It has been found that using flexible circuitry for edge card connectors provides numerous advantages. First, much smaller pitches may be utilized, such as on the order of about 0.3 mm. This reduced pitch permits an even greater reduction in the size of the connectors. Second, flexible circuitry provides certain benefits to signal performance, especially with high speed signals. For example, by using conventional coplanar, microstrip or stripline configurations that are readily achievable with flexible circuitry, faster signal rise times and higher signal frequencies may be accomplished. Through the control of the dielectric materials, material thicknesses and circuit positioning parameters, it is possible to achieve improved impedance matching, lower propagation delays as well as a reduction in reflection and crosstalk.

Flexible circuitry has been incorporated in some edge card connectors, such as those shown in U.S. Pat. No. 3,614,707 issued Oct. 19, 1971 and U.S. Pat. No. 5,427,533 issued Jan. 27, 1995. Both of these connectors have a formed connector housing with a longitudinal slot and a length of flexible circuitry extending over the connector slot such that the flexible circuitry depends into the connector slot. The user inserts the circuit card into the connector slot and forces the circuit card to the bottom of the slot, forcing the edge of the circuit card against the flexible film circuitry. Repeated insertions and removals of the circuit card may impart detrimental stress to the contacts on the flexible circuitry. Additionally, these connectors require springs of complex shape behind the flexible circuitry to ensure reliable contact with the circuit card which leads to increased manufacturing costs.

The present invention is therefore directed to a circuit card connector utilizing flexible circuitry which avoids the imposition of detrimental stress on the flexible circuitry and which provides a reliable circuit card-engaging means to apply a reliable contact force to the circuit card.

One object of the present invention is to provide an improved circuit card connector which utilizes flexible circuitry as the connector contacts and which utilizes an improved circuit card-engagement assembly.

Another object of the present invention is to provide a circuit card connector having two opposing end portions formed from an insulative material and a circuit card engaging assembly supported between the connector end portions, wherein the circuit card engaging assembly includes opposing, spaced-apart spring members which extend lengthwise between the connector end portions and which support the flexible circuitry thereon, the contact spring members being movably mounted upon fulcrums such that upon insertion of the circuit card into the connector, an insertion edge of the circuit card impinges upon portions of the contact spring members which act as cam surfaces to thereby cause the contact spring members to move about their associated fulcrums into engagement with the contacts of the circuit card.

Yet another object of the present invention is to provide an improved circuit card connector which applies reliable contact forces to a circuit card inserted therein, the connector including a circuit card-engaging assembly having two opposing, spring members separated by an intervening space, the space defining an entrance portion of a card-receiving slot of the connector, the spring members having upwardly extending spring arm portions and downwardly extending leg portions, the spring members engaging fulcrums which extend lengthwise along the connector and which support the spring members at locations between the spring arm and leg portions.

Still another object of the present invention is to provide an electrical connector having a spring-biased circuit card-engaging assembly, wherein the card-engaging assembly includes a cradle spring having two fulcrums formed thereon, the fulcrums supporting a pair of contact springs on opposite sides of a circuit card-receiving slot of the connector, the contact springs having leg portions extending below the fulcrums and arm portions extending above the fulcrums, the contact springs being movable about their associated fulcrum points under urging of the circuit card when the circuit card is inserted into the connector, such that when the circuit card impinges upon the contact spring leg portions, the contact spring arm portions are urged to move into contact with opposing sides of the circuit card to thereby exert a card contact force normal to the circuit card contacts.

Yet still a further object of the present invention is to provide a high speed, high density electrical connector which has a relatively low circuit card insertion force and that includes a circuit card-engaging assembly which reliably engages the circuit card without the need for an external connector actuating mechanism, the circuit card-engaging assembly having a preload or biasing force applied thereto which biases the card-engaging into a operative position which readily receives the circuit card.

SUMMARY OF THE INVENTION

In one principal aspect of the present invention and as exemplified by one embodiment of the invention, an improved circuit card connector is provided with a card-engaging assembly extending between two connector end portions and cooperates therewith to define a circuit card-receiving slot which extends lengthwise between the connector end portions. This card-engaging assembly includes a pair of opposing, spaced-apart spring members which support opposing lengths of flexible film circuitry. The spring members are supported between the connector end portions by a pair of fulcrums around which the spring members may move under the influence of the circuit card when the card is inserted into the card-receiving slot of the connector. The fulcrums in this embodiment may take the form of a pair of rails which extend lengthwise along the connector and support the spring members at locations intermediate opposing ends of the spring members.

In another principal aspect of the present invention and as exemplified by a second embodiment of the invention, the card-engaging assembly includes a pair of spring members supported on a pair of fulcrums which are formed as part of a cradle spring. The cradle has a plurality of upright engagement members that are received within a like plurality of openings disposed in the spring members which cooperate to maintain the spring members in place upon the cradle spring along the fulcrums.

In another principal aspect of the present invention, a preload, or biasing force, may be applied to the cradle spring and to the spring members to hold them in place within the connector and to maintain the spring members in an operative position in which the connector is ready to receive the circuit card. The insertion of the circuit card overcomes this preload and effects a camming action with respect to the spring members to effect a contact between the flexible circuitry and the circuit card.

In still another principal aspect of the present invention and exemplified by still another embodiment of the invention, the contact springs of the card-engaging assembly are rotatably supported on the cradle spring at specific hinge points which serve as fulcrums about which the contact springs move under the insertion of the circuit card.

In still yet another principal aspect of the present invention, the spring members include opposing arm and leg portions which contact the circuit card during insertion into the connector. The spring member leg portions are disposed generally below the fulcrums while the spring member arm portion are disposed generally above the fulcrums, such that the fulcrums define points about which the spring member leg and arm portions move in opposite directions in response to the insertion of the circuit card into the connector. During this insertion, the spring member leg portions move outwardly with respect to the card-receiving slot, while the spring member arm portions move inwardly toward the card-receiving slot such that the circuit card itself acts as an actuator in applying a contact force between the flexible circuitry and the circuit card contacts.

In another further principal aspect of the present invention and as exemplified in another embodiment of the invention, a cradle spring is provided to support a pair of contact springs. The cradle spring defines the lower extent of a circuit card-receiving slot of the connector and is supported on a connector base. The connector base includes means for applying an outward force to the cradle spring to ensure that the lower extent of the card-receiving slot of the connector retains a predetermined width. The cradle spring includes two engagement surfaces that extend lengthwise on opposite sides of the card-receiving slot and which serve as fulcrums while they support the contact springs on opposite sides of the card-receiving slot. The contact springs support flexible circuitry on opposing sides of the card-receiving slot. The cradle spring includes suitable engagement means which retain the contact springs in place thereon. The connector also includes a second biasing means which applies a force to the contact springs to retain them in an open position along the upper extent of the card-receiving slot.

These and other objects, features and advantages of the present invention will be clearly understood through a consideration of the following detailed description.

BRIEF DESCRIPTION OF THE DRAWINGS

In the course of the following description of the detailed description, reference will be made to the attached drawings wherein like reference numerals identify like parts and wherein.

DETAILED DESCRIPTION OF THE PREFERRED EMBODIMENTS

Figure 1:
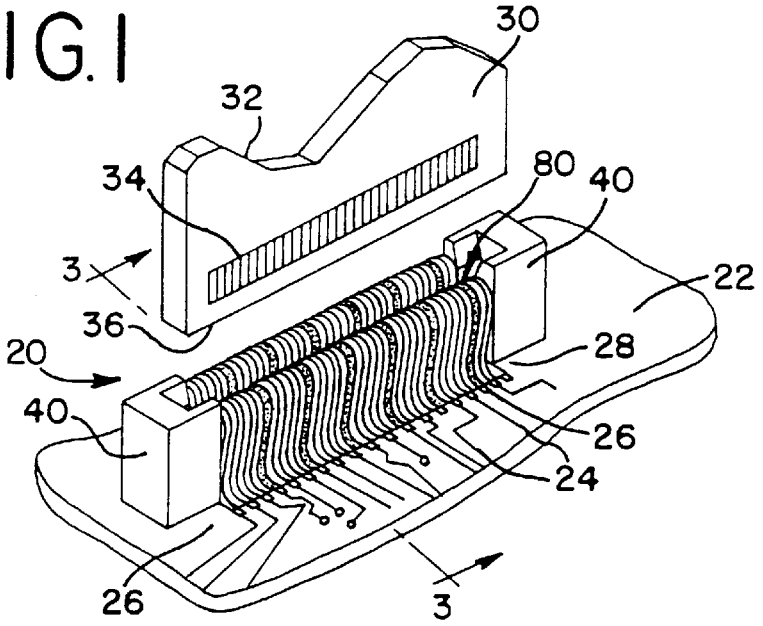
FIG. 1 is a perspective view of one embodiment of an improved circuit card connector constructed in accordance with the principles of the present invention.

FIG. 1 illustrates an edge card connector, generally indicated at 20, constructed in accordance with the principles of the present invention. The connector 20 is mounted to a primary printed circuit board 22 having a plurality of different circuits 24 disposed thereon leading to a plurality of associated contact pads or traces 26 located on a surface 28 of the circuit board 22.

The connector 20 is intended to provide a connection between the circuit board 22 and a secondary circuit card 30 having a generally planar substrate 32 and a plurality of contact pads 34 aligned along an insertion edge 36 of the circuit card 30. The circuit card 30 has its contact pads 34 disposed on both sides thereof, typically arranged in an array of one or more distinct rows, and these contact pads 34 may be electrically connected to each other in ways well known in the art to provide redundant contact surfaces in order to enhance the reliability of the circuit card-connector connection.

Figure 2:
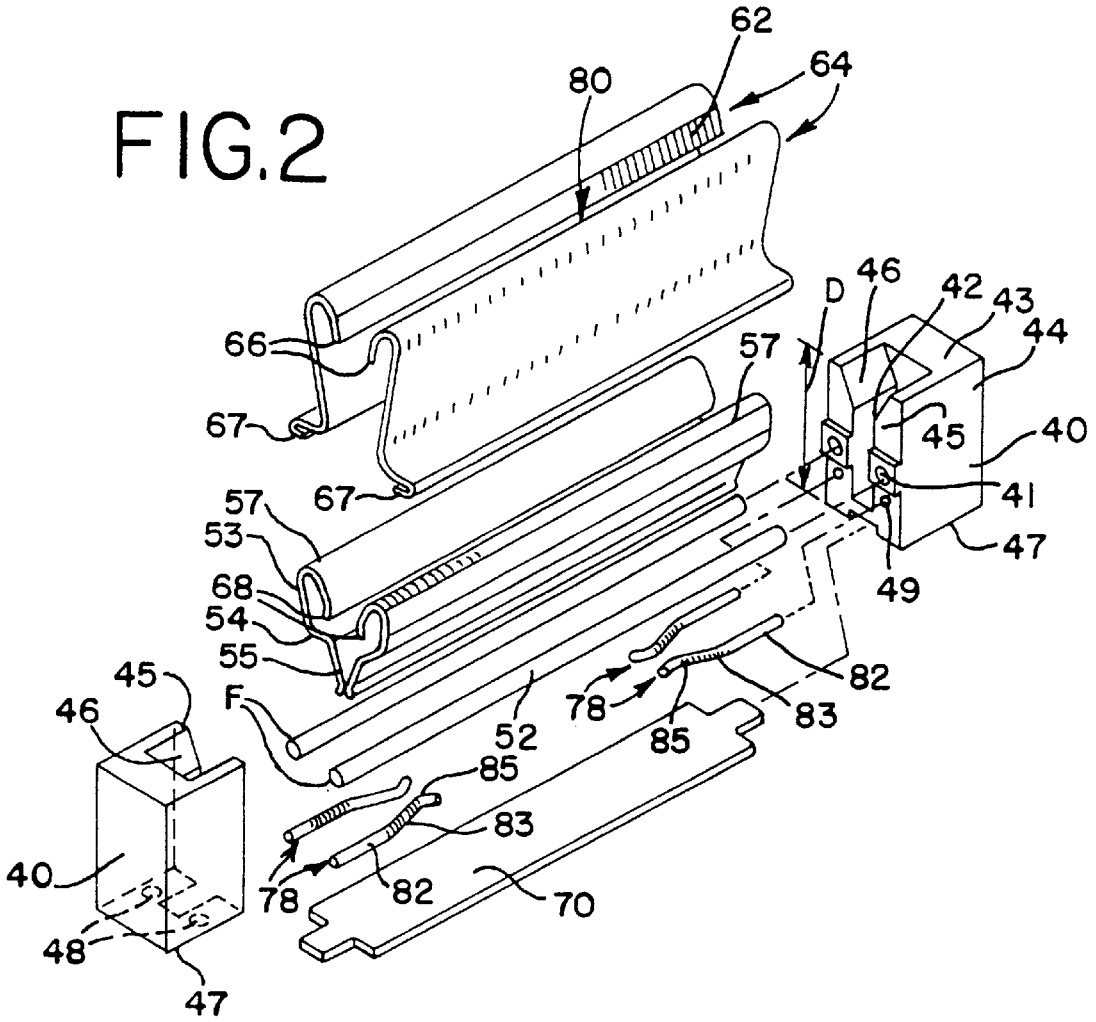
FIG. 2 is an exploded perspective view of the connector of FIG. 1.

Turning now to FIG. 2, it can be seen that the connector 20 has a housing which generally includes two opposing end portions 40, preferably which are molded from an electrically insulative material, such as plastic. These end portions 40, serve to define the overall length of the connector 20, its housing and the circuit card-receiving slot 80 of the connector 20. In this regard, the end portions 40, each include a recess 42 formed therein which extends down from the upper surfaces 43 thereof through the body 44 of the end portions 40 to a predetermined depth D. These recesses 42 communicate with the interior, opposing faces 45 of the end portions 40 and may include, in proximity to the upper surface 43, ramped portions 46, that provide lead-in surfaces into the recesses 42 to facilitate entry of the circuit card 30 into the connector card-receiving slot 80. Although the housing shown is defined by the two spaced-apart end portions 40 illustrated, it will be understood that the connector housing may include longitudinal sidewalls which extend the entire length of the connector 20 and which partially enclose the connector circuit card-engagement assembly 50.

The lower surfaces 47 of the end portions 40 are adapted to sit on the circuit board surface 28 and may be provided, as illustrated, with tapped openings 48 to accommodate mounting screws (not shown). Alternatively, any other suitable mounting means known in the art may be utilized, such as mounting lugs or posts. The end portion 40 may further include different openings 41, 49 for receiving various other components of the connector 20. The connector end portions 40 are preferably aligned lengthwise along a longitudinal axis of the connector 20 so that their respective recesses 42 and openings 41, 49 confront each other and preferably so that they are maintained in registration with each other on opposite sides of a centerline C (FIGS. 3–5) of the card-receiving slot 80 of the connector 20.

The connector end portions 40 not only define opposing ends of the connector circuit card-receiving slot 80 by way of their respective recesses 42, but they also support a circuit card-engagement assembly 50 therebetween. The components which make up this circuit card-engagement assembly 50 are individually illustrated in FIG. 2 and the operation of the assembly 50 is illustrated in FIGS. 3–5.

The card-engagement assembly 50 includes a pair of elongated rails 52 which extend lengthwise between the connector end portions 40 and which are supported thereby within respective openings 41 formed in the interior faces 45 of the end portions 40. The rails 52 are supported between the upper and lower surfaces 43, 47 of the connector end portions 40 and on opposite sides of the centerline C of the recesses 42 and of the card-receiving slot 80. The rails 52 in turn support a pair of circuit card-engagement members illustrated as flexible spring member 53.

The spring members 53 are solid throughout their length as illustrated, which increases the compliance of the connector 100 in overcoming manufacturing irregularities that may occur in the circuit card 30 and which would ordinarily prevent effective contact between the contacts of the connector 20 and the contacts 34 of the circuit card 30 were the contacts to be a plurality of individual spring arms rather than the continuous spring members 53 illustrated.

Figures 3, 4, 5:
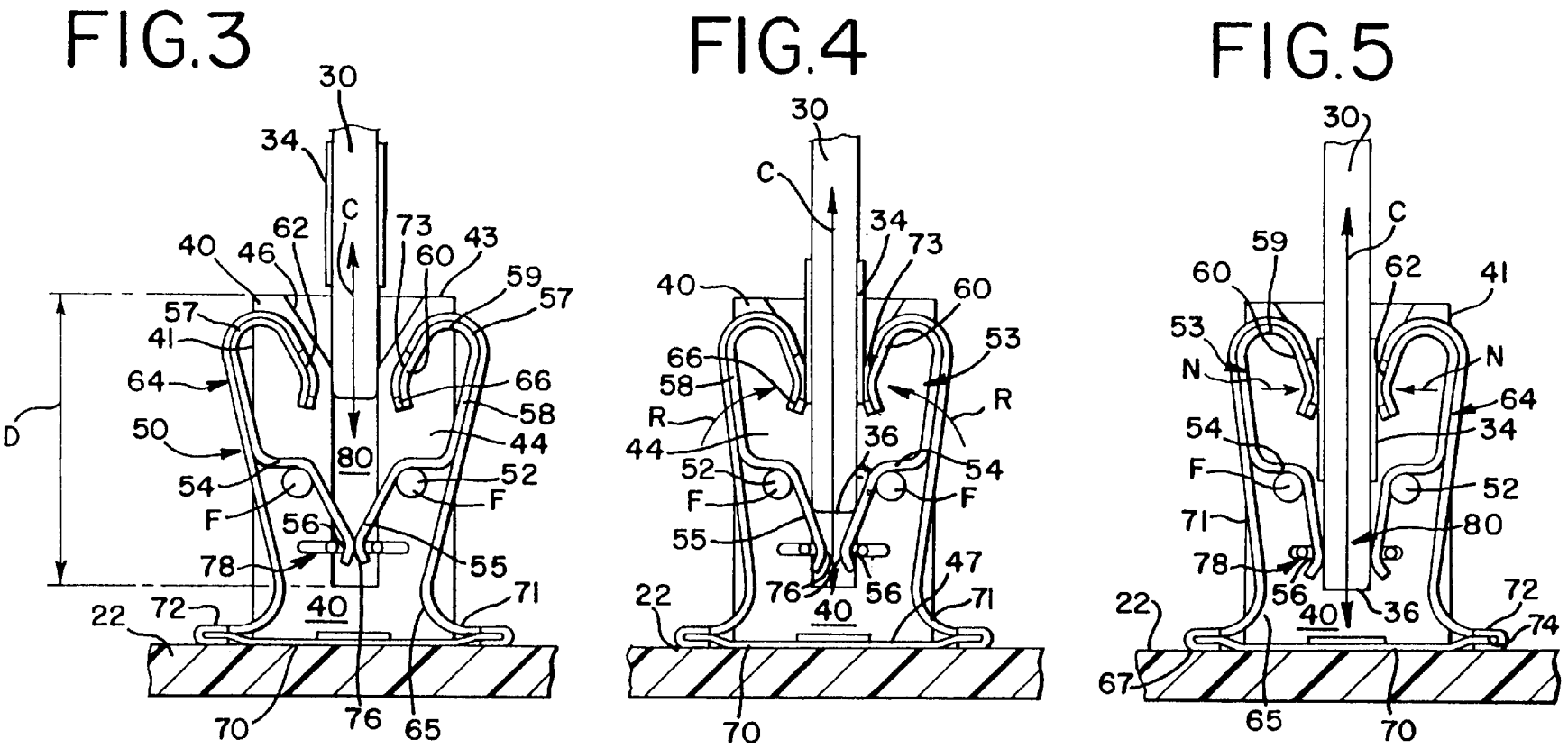
FIG. 3 is a cross-sectional view of the connector of FIG. 1 taken generally along lines 3—3 thereof illustrating a circuit card partially inserted into the card-receiving-slot of the connector.
FIG. 4 is a view identical to FIG. 3, illustrating further insertion of the circuit card into the card-receiving slot of the connector to the extent where the circuit card contacts the spring member leg portions of the connector.
FIG. 5 is a view identical to FIG. 4 illustrating the circuit card fully inserted into the connector card-receiving slot.

As best shown in any of FIGS. 3–5, the spring members 53 of the first connector embodiment 20 may include a seat, or step, portion 54 located intermediate the ends of the spring members 53 for the purpose of defining surfaces of the respective spring members 53 which rest on the support rails 52 of the connector. As will be explained in greater detail below, the rails 52 serve as fulcrums F in order to provide points about which the spring members 53 move during insertion and removal of the circuit card 30 from the connector 20. The structure of the spring members 53 differs on opposite sides of the fulcrums F in that, in the embodiment illustrated, spring member leg portions 55 are provided which depend downwardly from the fulcrums F. The leg portions 55 include a lower bend therein to define an retention spring channel 56 at which a retention force is applied to the spring members 53.

The spring members 53 further include card engagement portions located on the opposite sides of the seat portions 54, which are shown as spring arms 57 that have a general C-shaped configuration. The spring arms 57 extend upwardly from the seat portions 54 of the spring members 53 and may be considered as forming distinct backbone portions 58 and circuit card contact portions 60 which are bent back upon the backbone portions 58 in the manner shown and which are interconnected thereto by bight portions 59. The spring member seat portions 54 are angularly disposed with respect to the spring arm and leg portions 57, 55 and intersect therewith such that the leg portions 55 are offset both vertically and horizontally from the spring member arm backbone portions 58 as illustrated. It should be noted that the location of the spring member seat portions 54 may be moved in order to change the length of the lever arms provided by the spring member arm and leg portions 57, 55 and thereby change the force characteristics of the connector.

The spring members 53 may be formed from any suitable material which imparts the desired degree of resiliency to the card-engagement assembly 50. In this regard, the spring members 53 also provide support for a plurality of contacts 62 of the connector 20 which are formed in a length of flat flexible circuitry ("FFC") 64. Two such lengths of flat flexible circuitry are illustrated and this type of circuitry 64 is well known in the art and variations may be used such as that referred to as "flat flexible cable, flexible printed circuitry and flexible film circuitry" as well as by other descriptive names. However, for simplicity, this description uses only the term "flat flexible circuitry," but it is understood that the use of this term is for convenience only and is not to be understood as limiting the scope of the invention. Although two lengths of flexible circuitry 64 are illustrated in the Figures, it will be understood that a single length of flexible circuitry 64 may be used as well for connectors of the present invention.

This flat flexible circuitry 64 typically has a laminated-style construction in which a plurality of flexible electrical contacts 62 (which may include strips of copper, gold or other conductive foils) bonded to a flexible, electrically insulative layer 65, such as a polyamide film. The flexible circuitry 64, in appropriate applications, may also include several additional layers of contacts 62 separated by intervening insulating films in order to construct shielded flexible circuits. The flexible circuitry 64 may further include an outer insulative layer 71 which overlies portions of the contacts 62.

The two strips of flexible circuitry 64 illustrated in FIGS. 2–5 are supported on the spring members 53 in a manner such that they substantially envelop the outer perimeter surfaces of the spring member arms 57, namely the spring member inner contact arm portions 60 and the spring member arm backbone portions 58. In this regard, the flexible circuitry 64 is bonded at one, upper end 66 thereof to the upper free end 68 of each spring member 53 and at an opposing end 67 to a support plate 70 in any suitable manner.

The lower end 67 of the flexible circuitry 64 includes an open contact area 72 where the contacts 62 of the circuitry 64 are exposed for mounting to the appropriate surface 28 (FIG. 1) of the printed circuit board 22, while the other end 66 thereof has a similar contact area 73 where its outer protective and insulative layer 71 has been removed so that the contacts 62 thereon are exposed. These circuit card contact areas 73 are preferably positioned upon the spring arms 57 in the location shown such that they overlie the contact arm portions 60 that are disposed generally opposite the circuit card contact pads 34 when the circuit card 30 is fully inserted into the card-receiving slot 80. (FIG. 5.) As best shown in FIGS. 3–5, the lower ends 67 of the flexible circuitry 65 may be folded upon themselves as shown to form two opposing slots 74 (FIG. 5) which receive the support plate 70 therein. To increase the stability of the lower portion of the connector 20, the support plate 70 may be bonded in any suitable manner to the lower ends 67 of the flexible circuitry 64.

The flexible circuitry 64 and the spring members 53 which support it cooperate to define a circuit card-receiving slot 80 of the connector 20. This card receiving slot 80 extends lengthwise along the connector 20 and communicates with the two recesses 42 formed in the opposing connector end portions 40. FIGS. 3–5 illustrate the interaction of the components of the card engagement assembly 50 during the insertion of a circuit card 30 into the connector 20.

With specific reference to FIG. 3, the connector 20 is shown in cross-section at an initial, or ready, position where the two opposing spring members 53 rest upon the fulcrum points F defined by the connector rails 52. In this position, the leg portions 55 (i.e., those portions of the spring members 53 which extend downwardly from the seat portions 54) contact each other in an abutting relationship lengthwise along the length of the rails 52 at the confronting surfaces 76 of the leg portions opposite the retention channels 56. In the embodiment shown, the opposing spring member leg portions 53 are maintained in this engagement by a series of retaining springs 78 which extend from the connector end portions 40 for a predetermined length on opposite sides of the centerline C of the card-receiving slot 80.

Figure 6:
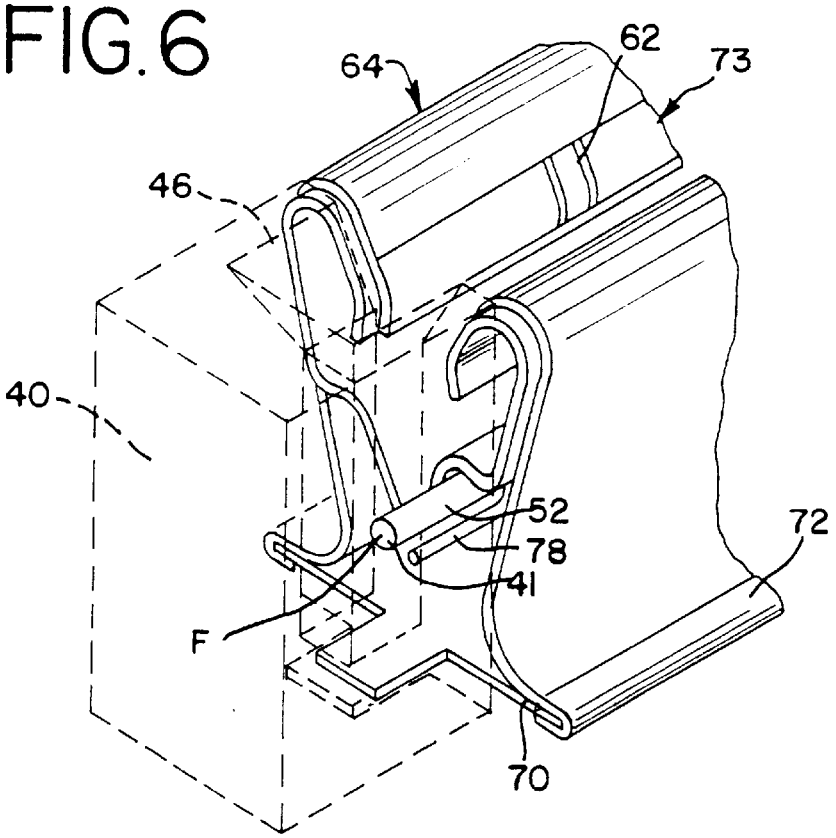
FIG. 6 is a perspective view of one end of the connector of FIG. 1.

As shown in FIGS. 2 & 6, the retaining springs 78 are received supported in openings 49 formed in the opposing interior faces 45 of the connector end portions 40. The retaining springs 78 each include a shaft portion 82 which engages the connector end portions 40 and an inwardly extending spring arm 83 having a contact portion 85 which is offset from the shaft portion 82 as shown. The spring arms 83 extends inwardly of the connector at an acute angle in order to provide a preload to the retaining springs 78 and therefore serve to hold the spring member leg portions 55 together in contact generally adjacent the bottom of the card-receiving slot 80.

When the circuit card 30 is partially inserted into the connector card-receiving slot 80 to the position illustrated in FIG. 4, the insertion edge 36 of the circuit card 30 impinges upon the spring member leg portions 55. These spring member leg portions 55 act as cams or levers in that further movement of the circuit card 30 into the connector slot 80 will incrementally separate the spring member leg portions 55 apart, causing them to rotate about their fulcrums F, and resulting in the spring member arms 57 rotating in opposite directions also around the fulcrums F as shown by the arrows R in FIG. 4. The downward insertion movement of the circuit card 30 is partially resisted by the retention force applied to the spring member leg portions 55 by the retaining springs 78 in their contact against the retention spring channels 56 in order that the card-engagement assembly 50 is able to exert an internal control of the card insertion.

Further movement of the circuit card 30 to a completely inserted state as shown in FIG. 5 results in the spring member leg portions 55 being spread apart a distance equal to the width, or thickness, of the circuit card 30, resulting in a secure mating being effected between the circuit card contact pads 34 and the flexible contacts 62.

The movement of the spring member leg portions 55 in this manner forces the spring member arm portions 57 against opposing surfaces of the circuit card 30 and the contact portions 60 which are, in effect, cantilevered from the backbone and bight portions of the spring member arm portions 57, are thereby urged against the circuit card 30. The outward pressure applied to the spring member leg portions 55 by insertion of the circuit card 30 results in an effective normal contact force N (FIG. 5) being applied by the spring member arm portions 57 against the circuit card 30. This normal force N firmly holds the flexible circuitry 62 and particularly, its contact areas 73, against the circuit card contact pads 34. This concentrated normal force and the solid nature of the spring members 53 make the connector 20 more compliant and able to overcome manufacturing irregularities which may occur in the production of circuit cards 30 wherein the opposing sides of the circuit card 30 are not entirely planar and level. Furthermore, during the insertion phase, the backbone portions 58 of the spring members 53 move from a position where they lie partially outside the sides of the connector housing (FIG. 3) to a position where they lie within or aligned with the sidewalls 41 of the connector end portions.

Figure 7:
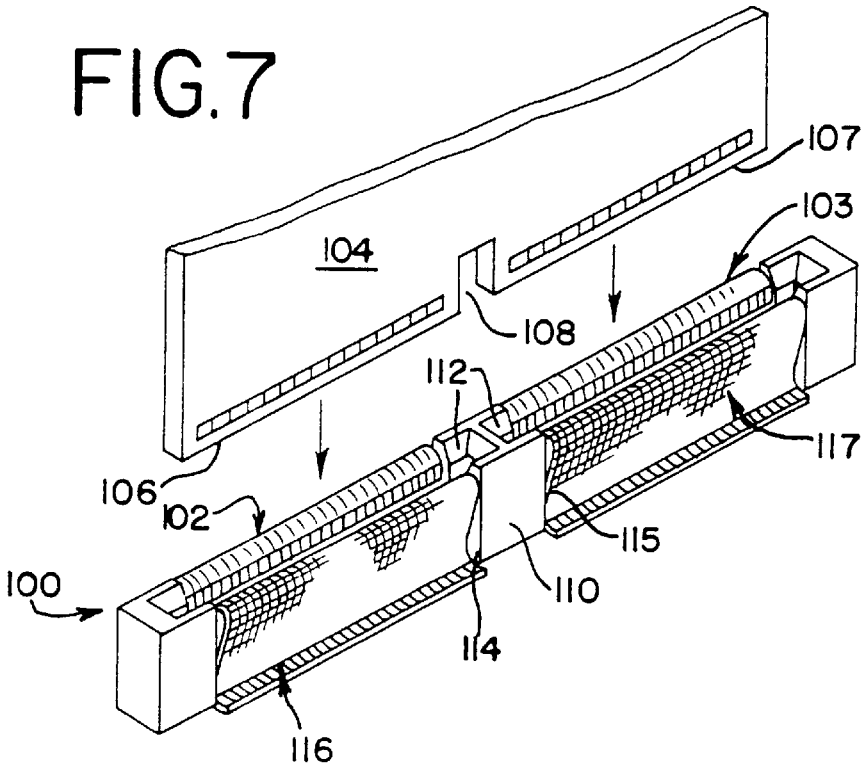
FIG. 7 is a perspective view of a second embodiment of an edge card connector constructed in construction with the principles of the present invention and illustrating a two-bay connector.

The connector 20 of FIGS. 1–6 may be modified to accommodate more than one circuit card, or a longer circuit card 104 as illustrated in FIG. 7, wherein another circuit card connector 100 constructed in accordance with the principles of the present invention may be seen to include two or more connector "bays" 102, 103, each of which is intended to receive either two separate circuit cards or the circuit card 104 having two distinct insertion edges 106, 107 separated by an intervening notch 108. The structure of the connector 100 is generally the same as the first embodiment of the connector 20 except that it includes an intermediate housing portion 110 having two card-receiving recesses 112 formed on opposing sides 114, 115 thereof. The opposing sides 114, 115 also include fulcrum support openings and retaining spring openings to support the fulcrum rails and retaining springs. Two card-engaging assemblies 116, 117 are thereby supported between the connector housing end and intermediate portions.

The first embodiment 20 and the other embodiment 100 described above illustrate the general structural features of connectors of the present invention. The card-engagement assembly utilized in connectors of the present invention may take forms other than the specific spring member-rail assembly illustrated in FIGS. 1–6.

Figure 8:
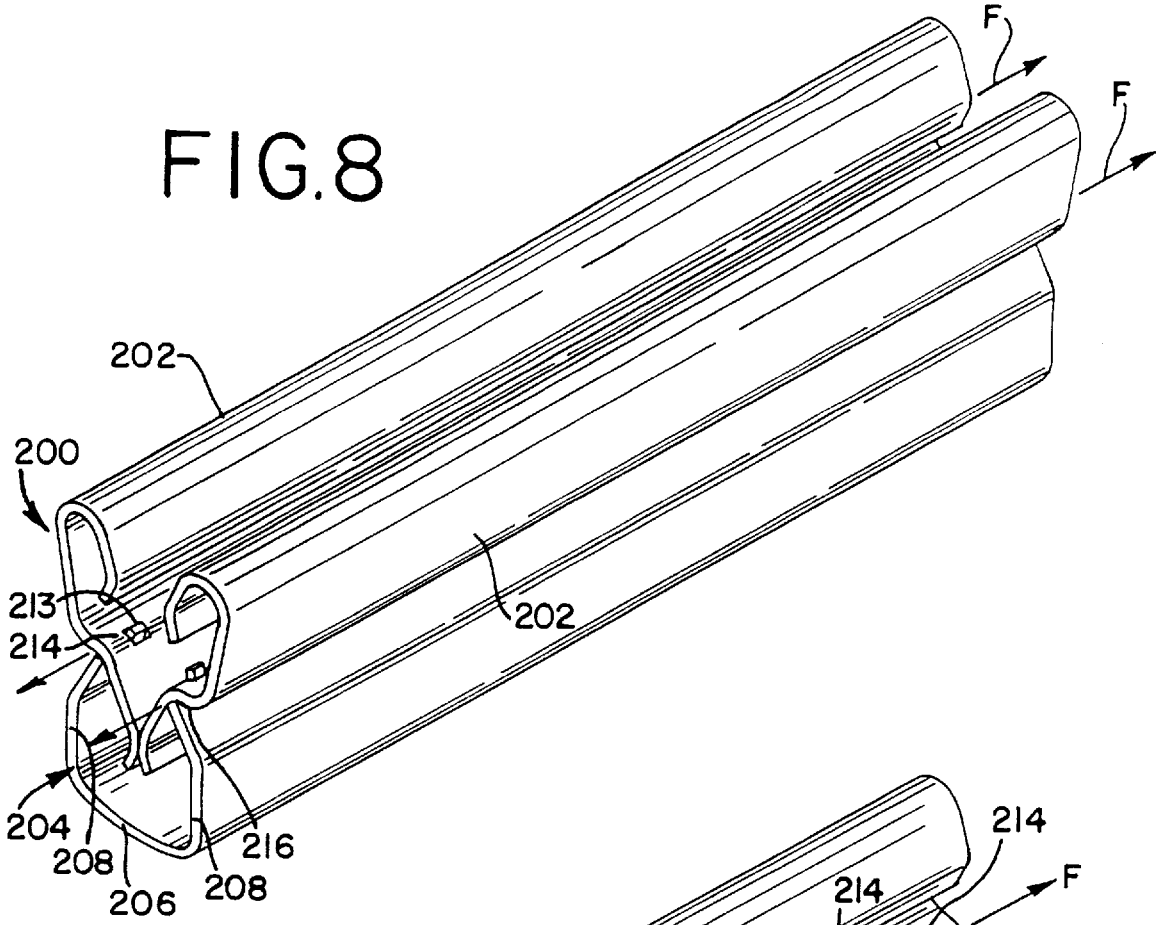
FIG. 8 is a perspective view of a circuit card-engagement assembly of a third embodiment of an edge card connector constructed in accordance with the principles of the present invention.
Figure 9:
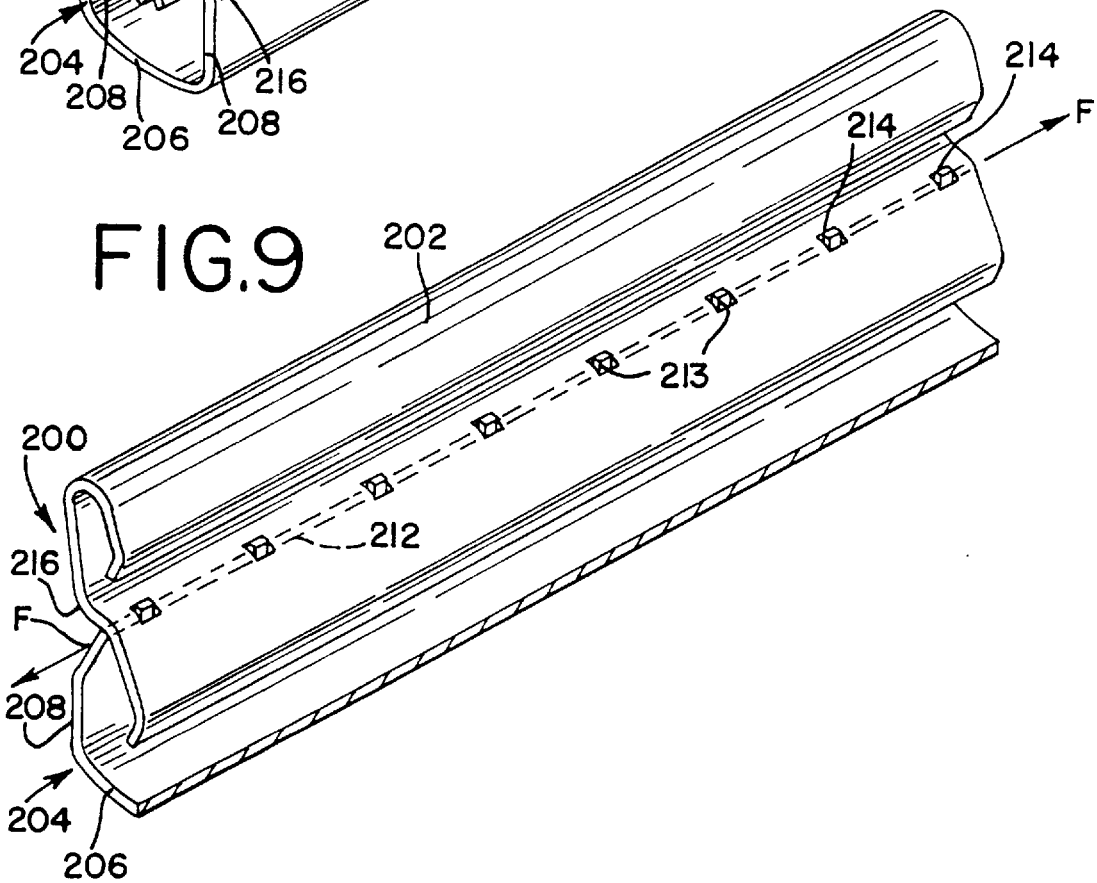
FIG. 9 is a view similar to FIG. 8, but with one half of the card-engagement assembly removed to illustrate the manner of engagement between the spring member and the fulcrum.

Turning now to FIGS. 8 & 9, such an alternate card-engagement assembly 200 is shown as having two opposing spring members 202 supported on a continuous cradle spring 204. The cradle spring 204 has a generally C-shape or U-shape as viewed from the end thereof and includes a support base 206, two arms 208 which extend upwardly from the base 206 and two fulcrums F which extend along free ends 212 of the arms 208.

In this third embodiment, the fulcrums F include a plurality of retention lugs 213 which are spaced apart in a desired spacing lengthwise along the fulcrums F between opposing ends of the card-engagement assembly 200. These retention lugs 213, as shown best in FIG. 9, are received within a series of openings 214 located along the seat portions 216 of the spring members 202. These openings 214 are larger than the retention lugs 213 so as to minimize any contact which may inhibit the ability of the spring members 202 to move upon their respective fulcrums F due to interference between the two components.

Figure 10:
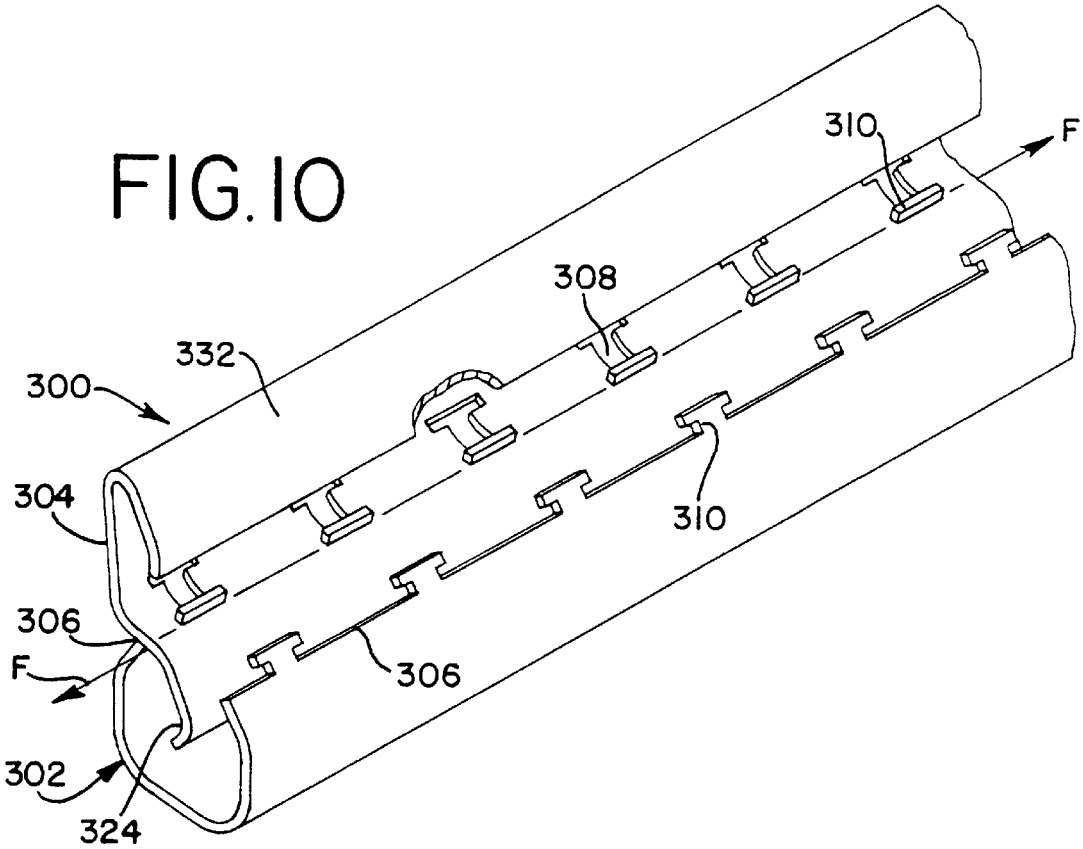
FIG. 10 is a perspective view of a card-engagement assembly utilized in a fourth embodiment of an edge card connector constructed in accordance with the principles of the present invention with one of the spring members removed for clarity.
Figure 11:
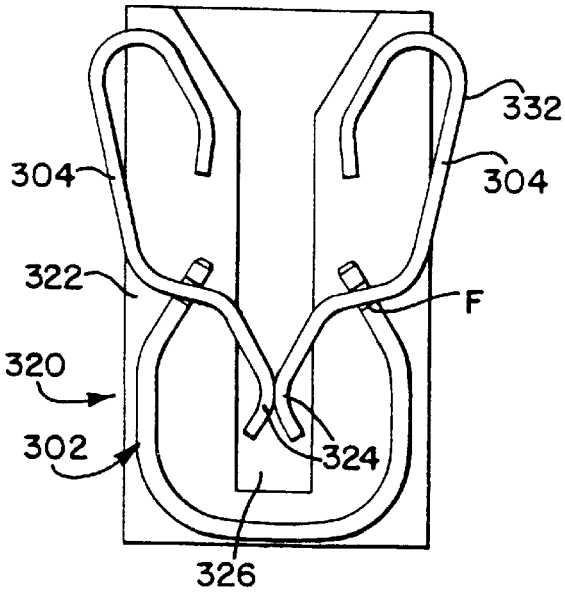
FIG. 11 is a cross-sectional view of the card-engagement assembly of FIG. 10 showing the assembly in place within a connector housing at a rest position without a circuit card inserted therein and with the flat flexible circuitry removed for clarity.
Figure 12:
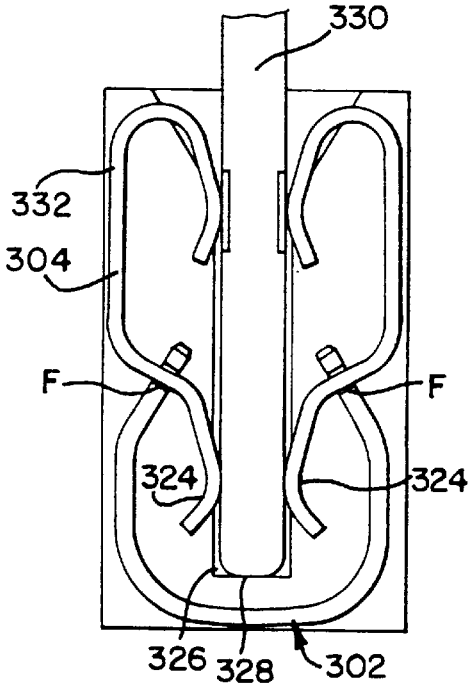
FIG. 12 is a view identical to FIG. 11, but illustrating a circuit card fully inserted into the card-engagement assembly.

FIGS. 10–12 illustrate a fourth embodiment of a card-engagement assembly 300 which may be utilized in the connectors of the present invention. In this embodiment, the assembly 300 includes a continuous support cradle 302 having a generally U-shape or C-shape with two opposing spring members 304 supported on two free edges 306 of the cradle spring 302 that serve as fulcrums F for the spring members 304. The spring members 304 each include a plurality of slots 308 formed therein which receive associated retention lugs 310 of the cradle spring 302 therein.

In this embodiment, both the slots 308 and the retention lugs 310 have a general T-shape that permits them to be easily assembled in an interlocking relationship and also ensures that the spring members 304 will be retained in their proper position upon the fulcrums F. The width of the top of the "tees" of the slots 308 is preferably greater than the width of the top of the "tees" of the retention lugs 310 and the bodies of the slots 308 are wider than the bodies of the retention lugs 310 in order to facilitate the assembly of the card-engagement assembly 300 without binding, once the assembly 300 is in its assembled position.

An important characteristic of all of the embodiments of the present invention disclosed herein is the ability of the spring members to "rock" or move back and forth upon their respective fulcrums in response to the insertion of a circuit card into the card-receiving slot of the connector and in effect, act as lever arms. This type of rocking action in the fourth embodiment is illustrated in FIGS. 11 & 12, wherein FIG. 11 illustrates the card-engagement assembly 300 in an initial, ready position in place within a connector housing 320, with the flexible circuitry removed for clarity and with one of the endwalls 322 of the housing being visible in the Figures. In this ready position, the spring members 304 rest in place upon the cradle spring 302 such that their opposing leg portions 324 contact each other within the perimeter of the circuit card-receiving slot 326. When a circuit card 330 is inserted into the slot 326, the circuit card insertion edge 328 engages the leg portions 324 of the spring members and causes them to spread apart, thereby rotating or rocking the spring members 304 about their fulcrums F. In this movement, the arm portions 332 of the spring members 304 are rotated in opposite directions about their respective fulcrums F and thereby brought into contact against the opposing surfaces of the circuit card 330 as shown.

In one alternative embodiment, rather than relying upon a separate biasing means to position the spring member leg portions 324 together, the spring members may be constructed so that the leg portions 324 thereof have a length and mass less than that of the arm portions 332, so that the mass of the spring arm portions 332 applies a biasing force to the spring members causing them to pivot partially about the fulcrums F so that the spring member leg portions 324 will naturally extend into the card-receiving slot 326 and force the spring member arm portions 332 and the flexible circuitry supported thereon away from the insertion edge of the circuit card. Hence, the spring member leg portions 324 which extend into the card-receiving slot 326 act as cam surfaces upon which the insertion edge and the opposing surfaces of the circuit card "ride" to thereby actuate of the connector to effect reliable engagement of the circuit card.

Figure 13:
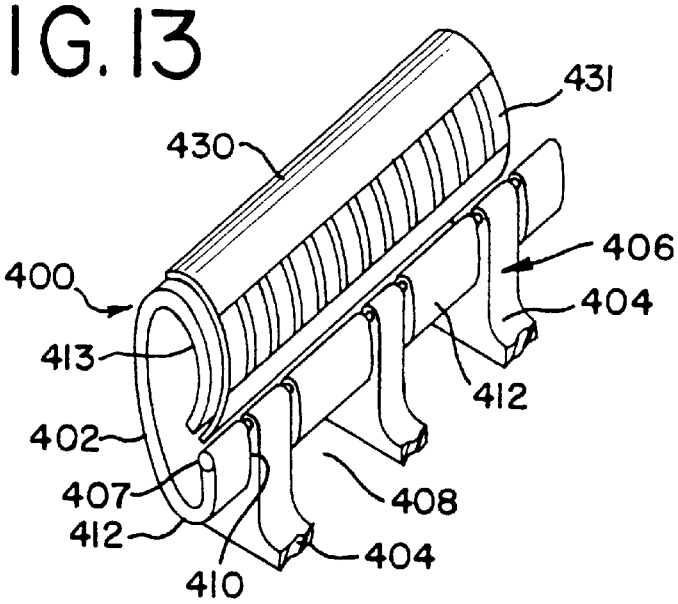
FIG. 13 is a perspective view of a card-engaging assembly utilized in a fifth embodiment of the present invention with one side thereof removed for clarity.
Figure 14:
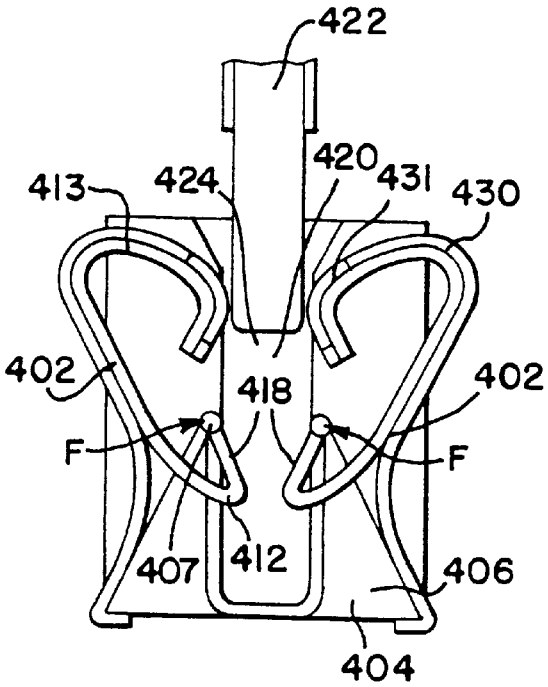
FIG. 14 is a cross-sectional view of a circuit card-engaging assembly of the type illustrated in FIG. 13 showing the initial insertion of a circuit card therein.
Figure 15:
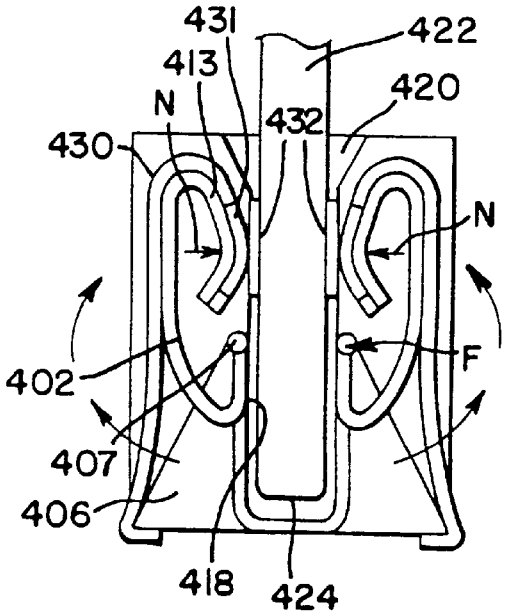
FIG. 15 is the same view as FIG. 14 but showing the circuit card fully inserted into the card-engagement assembly.

FIGS. 13–15 illustrate yet another embodiment of a card-engagement assembly 400 suitable for use in conjunction with connectors of the present invention in which the spring members 402 are supported upon a connector rocker base 404. The rocker base 404, as illustrated in FIG. 13, has a plurality of U-shaped supports 406 spaced apart lengthwise to define intervening spaces 408 therebetween. The spring members 402 have a series of slots 410 also spaced apart lengthwise along their leg portions 412 thereof. The spring member slots 410 receive the supports 406 of the rocker base 404, while the intervening spaces 408 of the connector rocker base 404 receive the leg portions 412 of the spring members 402. The spring members 402 and rocker base supports 406 are interconnected together by shafts 407 which extend lengthwise along common hinge points F that serve as fulcrums for the spring members 402 to partially rotate about.

The spring members 402 are free to move, or rock about the hinge points F and accordingly the hinge points F are positioned at a location between the spring member arm and leg portions 413, 412 so that when the connector 400 is in a ready, non-engaged state, as shown in FIG. 14, where a circuit card 422 has not yet been inserted into the card-receiving slot 420, the spring members 402 will possess a tendency to rock "open" and the flexible circuitry contacts 431 will be maintained away from the insertion edge 424 of the circuit card 422. That is, the spring member arm portions 413 will tend to extend or rock outwardly at an angle to the card-receiving slot 420 of the connector, because of the location of the hinge points F and the difference in length and mass of the spring arm portions 413 as compared to that of the spring leg portions 412. This natural bias also causes the spring member leg portions 412 to move and extend inwardly of the card-receiving slot 420. Alternatively, means may be provided to bias the spring members 402 to this position.

Insertion of a circuit card 422 into the card-receiving slot 420 as shown in FIG. 15 causes the insertion edge 424 of the circuit card 422 to engage the cam surfaces 418 presented by the extent of the spring leg portions 412 into the card-receiving slot 420, causing the spring leg portions 412 to rotate outwardly in the manner shown, which brings the spring member arm portions 413 inwardly and the flexible circuitry 430 supported thereon into contact with the contacts 432 on opposing surfaces of the circuit card 422.

It therefore can be seen that the present invention provides a cam-like contact mechanism as its card-engagement assembly with a small number of components in which the cam-like contact mechanism utilizes simple spring concepts.

FIGS. 16–21 illustrate still another embodiment of a circuit card connector 500 constructed in accordance with the principles of the present invention. In this embodiment, the connector card-engagement assembly 502 includes means for applying preloads or biasing forces to certain components of the assembly 502. The connector 500 includes two opposing end portions 504, each of which has a vertical recess 506 disposed therein which receive the opposing ends of a circuit card (not shown) inserted into the connector 500. These recesses 506 serve to form the ends of the circuit card-receiving slot 508 of the connector 500 and accordingly, are aligned with each other along a longitudinal axis of the connector 500. The connector end portions 504, similar to the embodiment of FIGS. 1–6, may include ramped surfaces 510 which serve as lead-ins to the card-receiving slot 508 and have flat lower mounting surfaces 512 which are suitable for mounting the connector 500 upon a surface of a printed circuit board 513 in any suitable manner.

The connector end portions 504 may also include hollow cavities or recesses 514 formed in the lower surfaces 512 which receive opposing end tabs 516 of a connector base member 518. The base member 518 extends lengthwise between the connector end portions 504 and has a width slightly greater than the end portions 504 in order to provide support for the flexible circuitry 560 of the connector 500. The base member 518 further has a flat central portion 520 (FIG. 20) which may be considered as defining the lowermost extent 522 of the card-receiving slot 508. A plurality of posts 524 extend upwardly from the base member 518. These posts 524 are spaced apart from each other both lengthwise and laterally within the connector 500 and further flank the base member central portions 520 to provide a preload, or biasing force to the card-engagement assembly cradle spring 530 as explained in greater detail below. Additionally, the posts 524 of the connector base member 518 will hold the cradle spring 530 in position to maintain a predetermined separation between the free ends of the cradle spring regardless of the tolerances to which the cradle spring may be made.

Figure 18:
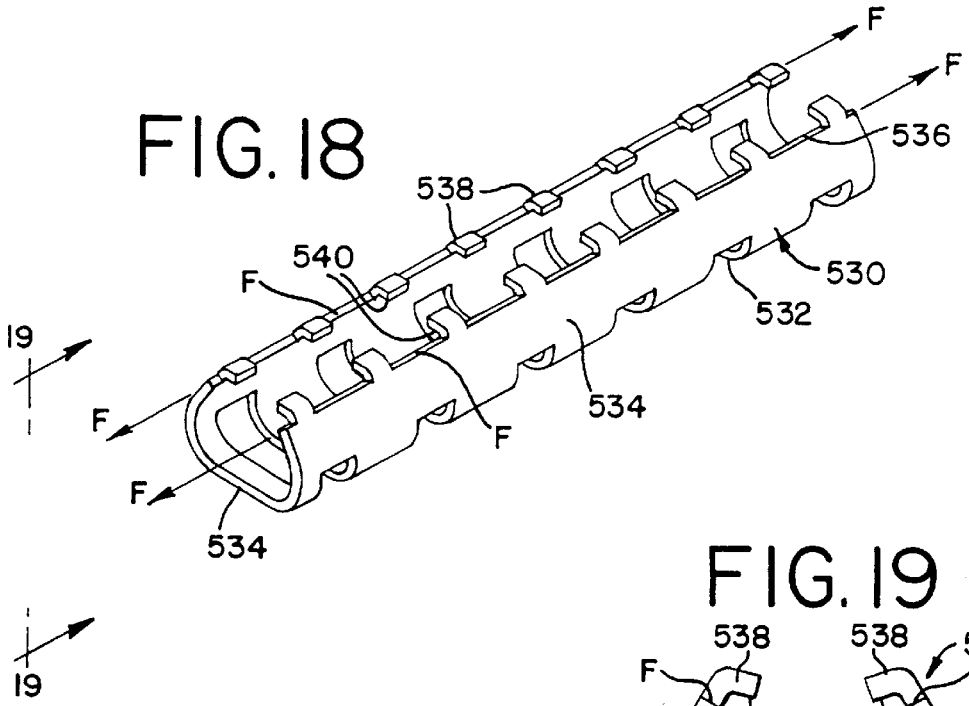
FIG. 18 is a perspective view of the spring cradle component utilized in the card-engagement assembly of the connector of FIG. 16.
Figure 19:
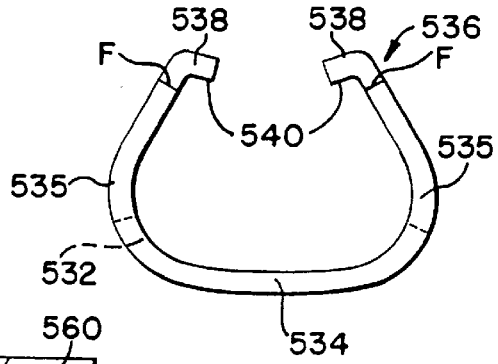
FIG. 19 is an end view of the spring cradle of FIG. 18 taken generally along lines 19—19 thereof.

The cradle spring 530 extends lengthwise between the connector end portions 504 and includes a plurality of transverse slots 532 which are spaced apart from each other in the longitudinal direction as seen best in FIG. 18 and which are dimensioned to receive the posts 524 of the base member 518. As seen in FIG. 19, the cradle spring 530 has a base portion 534 and two sidewalls 535 extending upwardly therefrom which terminate in free ends 536. The free ends 536 define surfaces which act as two fulcrums F for the card-engaging assembly 502. These fulcrums F lie on opposite sides of the centerline C of the connector 500 and of the card-receiving slot 508 and support a pair of contact springs 550. The free ends 536 preferably further include a series of engagement lugs or bent portions 538 which serve to retain the contact springs 550 in place along the fulcrums F. These lugs 538 extend laterally inwardly from the sidewalls 535 so that the undersurfaces 540 thereof will engage the contact springs 550.

The posts 524 of the base member 518 have non-planar exterior surfaces 542 which are somewhat complimentary to the configuration of the cradle spring sidewalls 535 and may also be slightly laterally displaced outwardly with respect to the sidewalls 535 in order to apply a predetermined or outwardly directed biasing force against the cradle spring 530. In other words, the distance between the exterior surfaces of a pair of laterally aligned posts 524 is slightly greater than the horizontal width of the cradle spring slots 632.

Figures 16, 17:
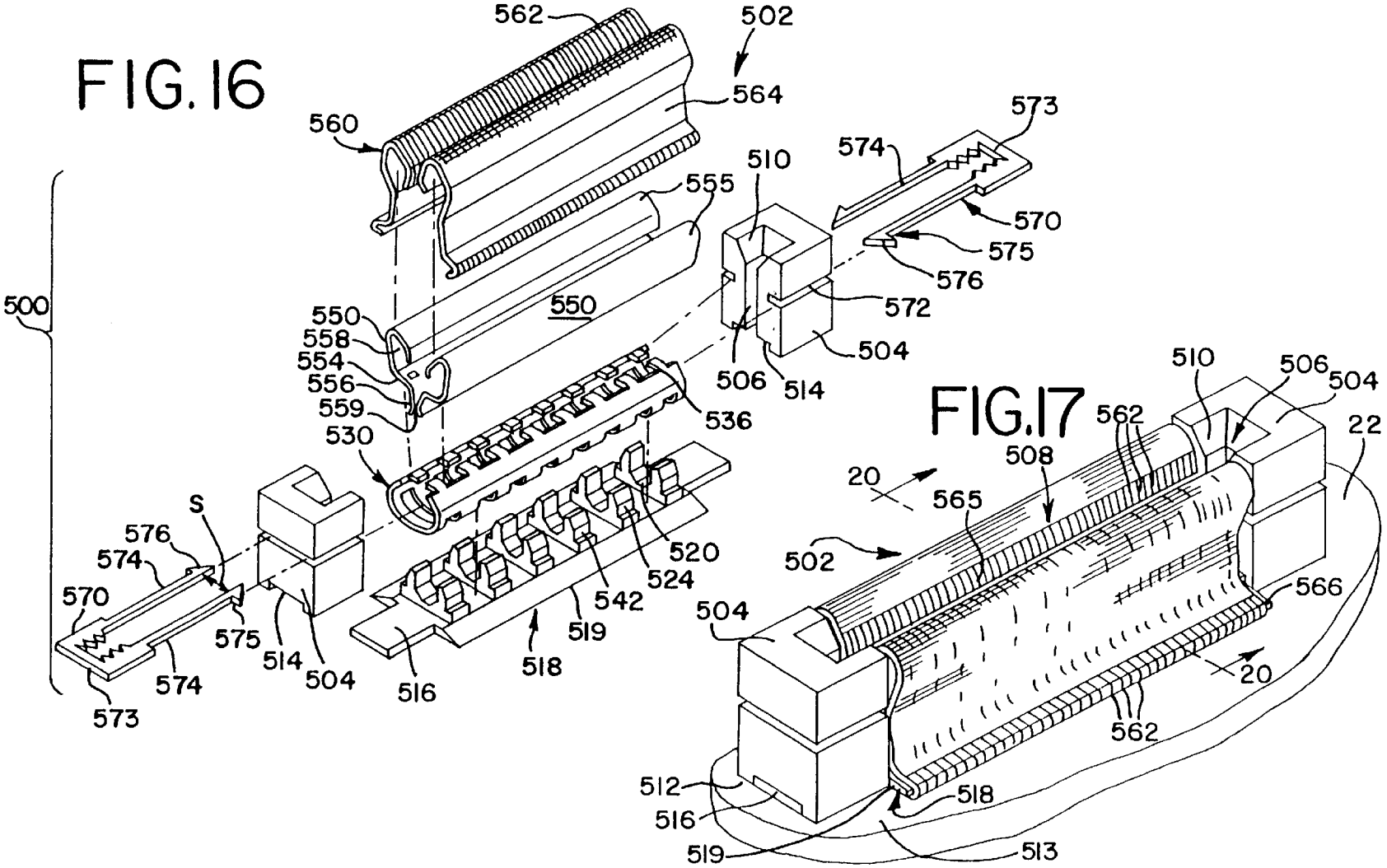
FIG. 16 is an exploded perspective view of a sixth embodiment of a circuit card connector constructed in accordance with the principles of the present invention.
FIG. 17 is a perspective view of the connector of FIG. 16 in p ace upon a printed circuit board.
Figure 20:
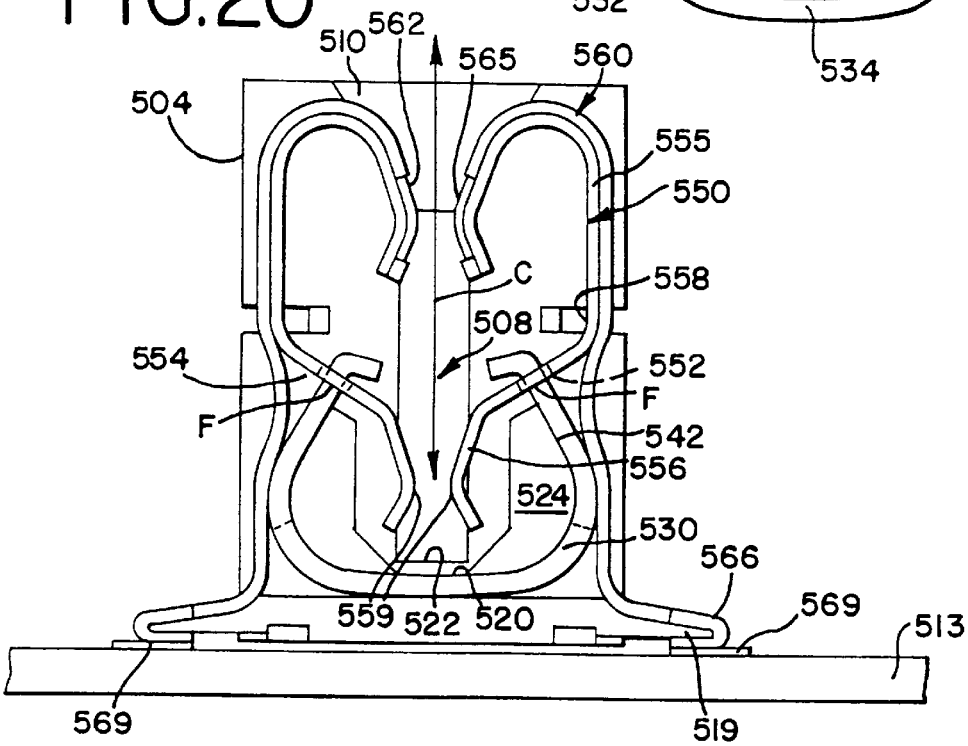
FIG. 20 is a sectional view of the connector of FIG. 17 taken along lines 20—20 thereof.
Figure 21:
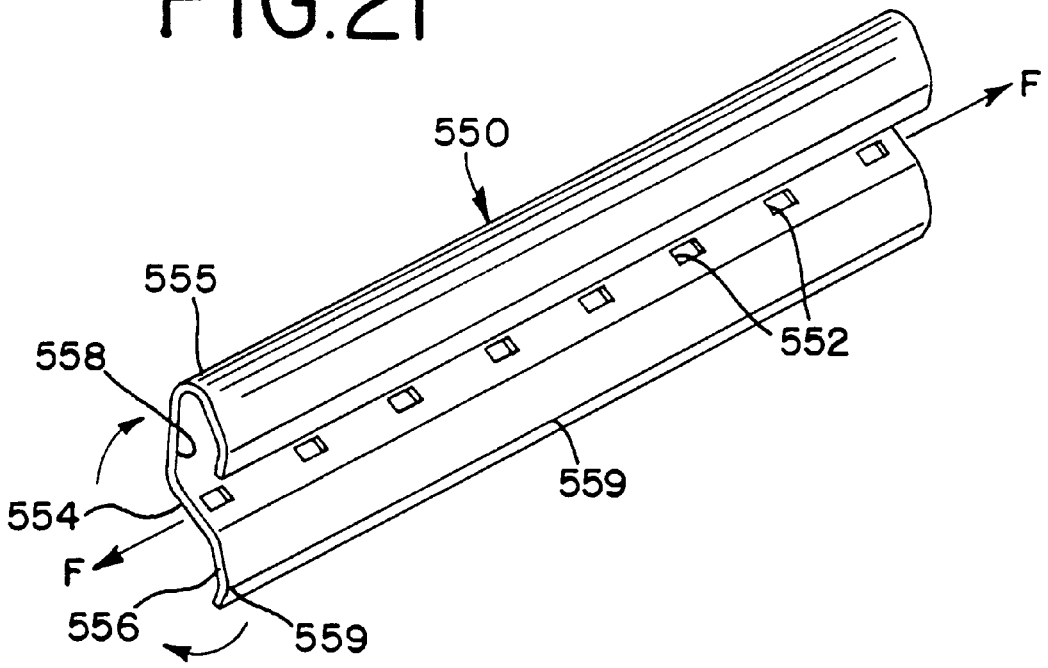
FIG. 21 is a perspective view of one of the contact spring members utilized in the card-engagement assembly of the connector of FIG. 16.

A pair of contact springs 550 extend lengthwise along the cradle spring 530 and include, as best illustrated in FIGS. 16 & 21, a plurality of openings 552 that extend lengthwise along seat portions 554 of the contact springs 550 and which are spaced apart in a similar spacing as the cradle spring engagement lugs 538. When assembled, the contact springs 550 rest on the fulcrums F of the cradle spring free ends 536 and the engagement lugs 538 extend through the openings 552. The contact springs 550 may be considered as having an end profile, a general B-type shape (the leftmost contact spring 550 in FIG. 20 having such an S-type shape and the leftmost contact spring 550 being a mirror image thereof) with distinct contact spring arms 555 and contact spring legs 556 located on opposite sides of the seat portions 554 thereof and extending lengthwise along the connector 500 at different levels within the card-receiving slot 508.

The contact spring arms 555 are located in the upper extent of the card-receiving slot 508, while the contact spring legs 556 are located in the lower extent thereof. The contact springs 550 are free to move or "rock" about the fulcrums F of the cradle spring 540 as described earlier herein with respect to the previous embodiments under the urging of a circuit card. The contact springs 550 serve as support surfaces for flat flexible circuitry 560 which is applied to the outer surfaces 558 of the contact spring arms 555, and as previously noted, may include a plurality of electrically conductive contacts 562 disposed thereon (FIG. 17.) The contacts 562 may be protected by an exterior insulative layer 564 which extends along the top and sides of the connector 500, but which is not applied over the contacts 562 at two contact areas 565, 566 located respectively within the connector slot 508 as shown in FIG. 20 and at the bottom side edges of the connector along feet 519 of the base member 518 where the contacts of the lower contact areas 566 are aligned and soldered to contact pads 569 of the circuit board 513.

The connector 500 includes another means for preloading the card-engagement assembly 502 shown illustrated in FIG. 16 as a pair of clips 570 which are received within outer slots 572 of the connector end portions 504. These clips 570 are generally C-shaped and include a connector housing engagement section 573 which engages the connector housing slots 572 and a pair of preloading spring arms 574 extending longitudinally therefrom. These preloading spring arms 574 are separated by a preselected spacing B and they extend lengthwise within the connector 500 along the contact spring arms 555 as shown in FIG. 20. The connector preloading spring arms 574 may include engagement heads 575 disposed at the free ends 576 thereof which have a barb-like configuration which is adapted to engage the contact spring 550 by pressing outwardly against the inner surfaces 558 of the spring arm portions 555 thereof as indicated in FIG. 20.

This outwardly biasing force will, in effect, preload the contact springs 550 so that they will have a tendency to move in opposite directions about their associated fulcrums F to thereby draw the spring leg portions 556 into the card-receiving slot 508. As illustrated with the previous embodiments described herein, the spring leg portions 556 have projecting cam surfaces 559 which the insertion edge of the circuit card will impinge upon when inserted into the card-receiving slot 508, thereby moving the contact spring arm and leg portions 555, 556 in opposite directions about the fulcrums to bring the exposed contact areas 562 of the flexible circuitry into contact with the contact pads of the circuit card.

Figure 22:
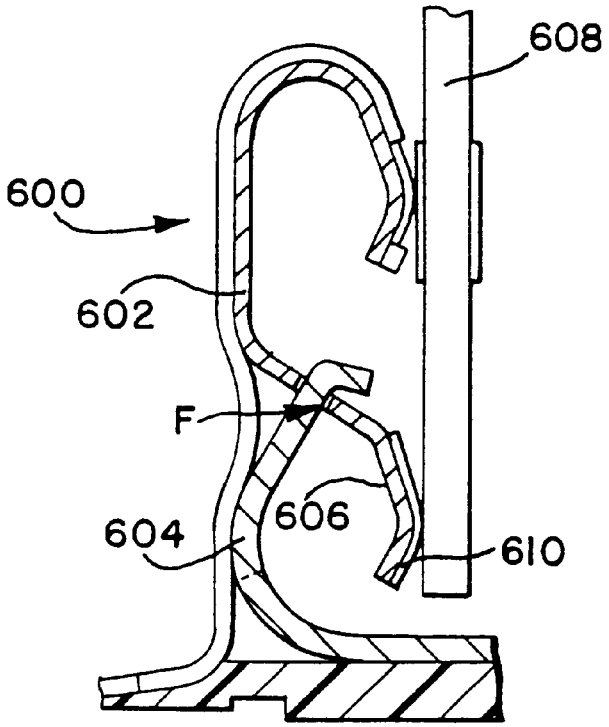
FIG. 22 is an enlarged view of one portion of the card-engagement assembly shown in FIG. 21 showing an alternate embodiment thereof.

FIG. 22 illustrates another embodiment of a card-engagement assembly 600 in which the contact spring 602 is supported upon an assembly cradle 604 similar to the embodiment previously described. However, in this embodiment 600, the spring leg portions 606 of the contact springs 602, may, in the areas beneath the fulcrums F, be insulated to prevent any conductivity from occurring between the spring leg portions 606 and the circuit board 608. This may be accomplished by applying an insulator or an insulating layer 610 to the contact spring leg portions 606 as illustrated. The insulating layer 610 may include a material with inherent lubricity which would serve to reduce circuit card insertion forces.

Connectors of the present invention may be constructed form a variety of materials. In this regard, the contact springs and the cradle spring may be formed from alloys such as beryllium copper, phosphor bronze and stainless steel which possess desirable spring characteristics. The connector end portions and base may be machined, cast or molded from materials such as aluminum, zinc, liquid crystal polymer. These are but examples of suitable materials and it will be understood that other suitable materials may also be used for the various connector components.

Accordingly, it will be appreciated that the embodiments of the present invention which have been discussed herein are merely illustrative of a few applications of the principles of the invention. Numerous modifications may be made by those skilled in the art without departing from the true spirit and scope of the invention.

We claim:

1. An electrical connector, comprising: a connector housing, a circuit card-receiving slot disposed on the connector housing for receiving an edge of a circuit card therein, at least one fulcrum extending along said connector housing in proximity to the circuit card-receiving slot, at least one card-engaging member disposed on said connector housing in proximity to said circuit card-receiving slot, the fulcrum movably supporting said circuit card-receiving member for movement about said fulcrum, said card-engaging member including first and second card-engagement portions, said first card-engagement portion extending at least partially into said circuit card-receiving slot, a flexible circuit element having a plurality of electrically conductive contacts disposed thereon, the flexible circuit element being operatively supported upon said card-engaging member second card-engagement portion such that it faces toward said circuit card-receiving slot, whereby, when a circuit card is inserted into said circuit card-receiving slot, said printed circuit card engages said card-engagement member first card-engaging portion and thereby moves said card-engagement member second card-engaging portion about said fulcrum and into contact with said circuit card.

2. The connector as defined in claim 1, further including a cradle member extending lengthwise of said connector housing, the cradle member having an elongated edge, said cradle member serving as said fulcrum, said card-engagement member being supported on said cradle edge.

3. The connector as defined in claim 1, wherein said card-engagement member first and second card-engaging portions move in opposite directions with respect to said fulcrum when said circuit card is inserted into said card-receiving slot.

4. The connector as defined in claim 1, wherein said second card-engaging portion is disposed on a lower portion of said card-engagement member and said first card-engaging portion is disposed on an upper portion of said card-engagement member.

5. The connector as defined in claim 1, further including a second fulcrum extending along said connector housing in proximity to the circuit card-receiving slot and spaced apart from said one fulcrum, and a second card-engaging member disposed on said connector housing in proximity to said circuit card-receiving slot, the second fulcrum movably supporting said second circuit card-receiving member for movement about said second fulcrum, said second card-engaging member also including first and second card-engagement portions that are aligned with and spaced apart from said first and second card-engaging portions of said one card-engagement member.

6. A printed circuit card connector for providing an electrical connection between a circuit board and a circuit card, the circuit card having an edge insertable into and removable from said connector, said connector comprising:

a connector housing having a card-receiving slot formed therein for receiving said circuit card edge therein;

a pair of circuit card-engagement members extending lengthwise along said connector on opposite sides of the card-receiving slot and individually supported upon two fulcrums, said circuit card-engagement members each including distinct first and second portions disposed thereon on opposite sides of said fulcrums;

flexible circuitry extending along said card-receiving slot and disposed on opposite sides of said card-receiving slot and, the flexible circuitry partially overlying said circuit card-engagement member second portions, said flexible circuitry including a plurality of contacts disposed thereon for contacting said circuit card edge, said fulcrums supporting said circuit card-engagement members such that they are movable upon said fulcrums between first and second operative positions, wherein, in the first operative position said card-receiving slot does not receive said circuit card therein and said circuit card-engagement member first portions extend into said card-receiving slot, and wherein in said second operative position when a circuit card is received in said card-receiving slot, said circuit card-engagement member first portions are contacted by said circuit card and moved apart, thereby moving said circuit card-engagement member second portions and said flexible circuitry supported toward said card-receiving slot and into engagement with said circuit card.

7. The circuit card connector of claim 6, wherein when said circuit card-engagement members are in said first operative position, said circuit card-engagement member first portions are spaced apart a distance less than a thickness of said circuit card to be inserted into said card-receiving slot.

8. The circuit card connector of claim 6, wherein said fulcrums include a pair of rails lengthwise along said connector housing.

9. The circuit card connector of claim 6, wherein said connector housing includes a cradle extending lengthwise thereof, the cradle having two spaced-apart, free ends disposed on opposite sides of said card-receiving slot, said free ends defining said fulcrums.

10. The circuit card connector of claim 9, wherein said cradle includes a plurality of engagement members disposed lengthwise in alignment with said fulcrums and said circuit card-engagement members include a plurality of openings that receive the cradle engagement members therein, said cradle engagement members retaining said circuit card-engagement members in place upon said fulcrums.

11. The circuit card connector of claim 6, further including means for biasing said circuit card-engagement members into said first operative position.

12. The circuit card connector of claim 6, wherein said circuit card-engagement members have a length no greater than the length of said fulcrums.

13. The circuit card connector of claim 6, wherein said flexible circuitry includes two separate lengths of flexible circuitry, each of the flexible circuitry lengths being disposed on opposite sides of said card-receiving slot and being no greater than the length of said fulcrums.

14. The circuit card connector of claim 6, wherein said circuit card-engagement member first portions have a mass greater than that of said circuit card-engagement member second portions such that said circuit card-engagement member second portions move outwardly away from said card-receiving slot when said circuit card-engagement members are in said first operative position.

15. The circuit card connector as defined in claim 6, wherein each of said circuit card-engagement members includes a seat portion which engages said fulcrums.

16. A circuit card connector for effecting an electrical interconnection between a circuit board and a circuit card, the connector comprising: a connector body portion, a circuit card-engagement assembly supported upon the connector body portion, the circuit card-engagement assembly including a pair of elongated, continuous contact members rotatably supported upon two opposing fulcrums, the contact members and the fulcrums being disposed on opposite sides of a centerline of said connector body portion and cooperatively defining a slot of said connector for receiving a portion of said circuit card therein, an extent of flexible circuitry disposed on opposite sides of said connector body centerline and extending lengthwise of said circuit card-receiving slot, said flexible circuitry being supported on confronting surfaces of said contact members, each of said contact members including a cam portion and a circuit card engagement portion, said fulcrums being respectively disposed intermediate the contact member cam portions and circuit card engagement portions of each contact member, said contact member cam portions extending into said circuit card-receiving slot in an initial position, whereby, when said circuit card is inserted into said circuit card-receiving slot, a portion of said circuit card impinges upon said contact member cam portions and moves them apart and out of said initial position, thereby further moving said contact member engagement portions about said fulcrums and toward each other into engagement with said circuit card portion.

17. The circuit card connector as defined in claim 16, wherein said flat flexible circuitry includes two separate portions, each of the portions being supported by one of said contact members.

* * * * *